US011133166B2

(12) United States Patent
Borisenko

(10) Patent No.: US 11,133,166 B2
(45) Date of Patent: Sep. 28, 2021

(54) MOMENTUM-RESOLVING PHOTOELECTRON SPECTROMETER AND METHOD FOR MOMENTUM-RESOLVED PHOTOELECTRON SPECTROSCOPY

(71) Applicant: Leibniz-Institut für Festkörper- und Werkstoffforschung Dresden e.V., Dresden (DE)

(72) Inventor: Sergey Borisenko, Dresden (DE)

(73) Assignee: Leibniz-Institut für Festkörper- und Werkstofffors, Dresden (DE)

( * ) Notice: Subject to any disclaimer, the term of this patent is extended or adjusted under 35 U.S.C. 154(b) by 0 days.

(21) Appl. No.: 16/771,705

(22) PCT Filed: Dec. 14, 2018

(86) PCT No.: PCT/EP2018/084995
§ 371 (c)(1),
(2) Date: Jun. 11, 2020

(87) PCT Pub. No.: WO2019/115784
PCT Pub. Date: Jun. 20, 2019

(65) Prior Publication Data

US 2021/0090868 A1 Mar. 25, 2021

(30) Foreign Application Priority Data

Dec. 15, 2017 (DE) ..... 102017130072.4

(51) Int. Cl.
*H01J 49/06* (2006.01)
*H01J 49/46* (2006.01)
*H01J 49/00* (2006.01)

(52) U.S. Cl.
CPC ..... *H01J 49/06* (2013.01); *H01J 49/0004* (2013.01); *H01J 49/46* (2013.01)

(58) Field of Classification Search
CPC ..... H01J 49/06; H01J 49/0004; H01J 49/46; H01J 37/10; H01J 37/12; H01J 2237/10;
(Continued)

(56) References Cited

U.S. PATENT DOCUMENTS 3,710,103 A * 1/1973 Helmer ..... H01J 49/488 250/305
3,766,381 A * 10/1973 Watson ..... H01J 49/484 250/283

(Continued)

FOREIGN PATENT DOCUMENTS

DE 19929185 A1 1/2001
DE 102013005173 A1 10/2014

(Continued)

OTHER PUBLICATIONS

Kotsugi etal, "Microspectroscopic Two-Dimensional Fermi Surface Mapping Using a Photoelectron Emission Microscope", Review of Scientific Instruments 74, 2754 (2003)). (Year: 2003).*

(Continued)

*Primary Examiner* — David E Smith
(74) *Attorney, Agent, or Firm* — Michael Soderman

(57) ABSTRACT

The invention relates to the field of physics and relates to an impulse-resolving photo-electron spectrometer, by means of which the physical properties can be determined. The aim of the invention is to provide an impulse-resolving photo-electron spectrometer enabling the device components to have a simple structure with a significantly reduced overall volume. The aim of the invention is achieved by means of an impulse-resolving photo-electron spectrometer comprising components arranged one behind the other in the direction of the optical axis at least in a vacuum and which are each at least one electron emission sample and a focusing system, wherein the focusing system consists of at least one electron lens and at least one detector, wherein the electron (Continued)

lens consists of three cylindrical elements, wherein the first cylindrical element has a potential=0 and the two subsequently arranged cylindrical elements have a potential of ≠0, and wherein the detector is one or more spatially resolved detectors which are arranged in the focal plane of the electron lens.

20 Claims, 1 Drawing Sheet

(58) Field of Classification Search
CPC ..... H01J 2237/12; H01J 2237/1207; H01J 2237/24485
See application file for complete search history.

(56) References Cited

U.S. PATENT DOCUMENTS

| | | | | | |
|---|---|---|---|---|---|
| 4,255,656 | A * | 3/1981 | Barrie | G01N 23/22 | 250/305 |
| 4,764,673 | A * | 8/1988 | Bryson, III | H01J 37/05 | 250/305 |
| 5,451,783 | A * | 9/1995 | Coxon | H01J 37/026 | 250/305 |
| 6,198,095 | B1 * | 3/2001 | Staib | H01J 37/252 | 250/287 |
| 7,655,923 | B2 * | 2/2010 | Daimon | H01J 37/12 | 250/396 R |
| 2007/0090288 | A1 * | 4/2007 | Shemesh | H01J 37/28 | 250/305 |
| 2018/0082829 | A1 * | 3/2018 | Muro | H01J 37/244 | |

FOREIGN PATENT DOCUMENTS

| | | | | |
|---|---|---|---|---|
| EP | 2950336 | A1 * | 12/2015 | H01L 31/035236 |
| EP | 2950336 | A1 | 12/2015 | |
| EP | 2851933 | B1 | 10/2016 | |
| WO | 2011019457 | A1 | 2/2011 | |
| WO | 2017010529 | A1 | 1/2017 | |

OTHER PUBLICATIONS

R. Ovsyannikov et al: "Principles and operation of a new type of electron spectrometer—ArTOF", Journal of Electron Spectroscopy and Related Phenomena., vol. 191, Dec. 1, 2013 (Dec. 1, 2013), pp. 92-103, XP055591190, NL ISSN: 0368-2048, DOI: 10.1016/j.elspec.2013.08.005 abstract; figure 3.

Kotsugi M et al: "Microspectroscopic two-dimensional Fermi surface mapping using a photoelectron emission microscope", Review of Scientific Instruments, AIP, Melville, NY, US, vol. 74, No. 5, May 1, 2003 (May 1, 2003), pp. 2754-2758, XP012040834, ISSN: 0034-6748, DOI: 10.1063/1.1569404 Section "II. Experiment"; figures 1, 3, 4, 5.

Clarke A et al: "Wave-Vector Imaging Photoelectron Spectrometer", Review of Scientific Instruments, AIP, Melville, NY, US, vol. 58, No. 8, Aug. 1, 1987 (Aug. 1, 1987) , pp. 1439-1444, XP002056850, ISSN: 0034-6748, DOI: 10.1063/1.1139429 Section "I. The Instrument" figure 1.

Rieger D et al. "A Display-Type Analyzer with an Image-Processing System for Angle-Resolved Photoelectron Spectroscopy", Nuclear Instruments and Methods, North-Holland Publishing Company, 208 (1983), pp. 777-784.

Matsuda H et al. Development of display-type ellipsoidal mesh analyzer: Computational evaluation and experimental validation, Journal of Electron Spectroscopy and Related Phenomena, 195 (2014) pp. 382-398.

Viartensson N. et al. "A very high resolution electron spectrometer", Journal of Electron Spectroscopy and Related Phenomena, 70 (1994) pp. 117-128.

Article Elektronenlinsen, Lexikon Der Physik, Spektrum.de, Printed on Jun. 3, 2020, 9:46 a.m.

* cited by examiner

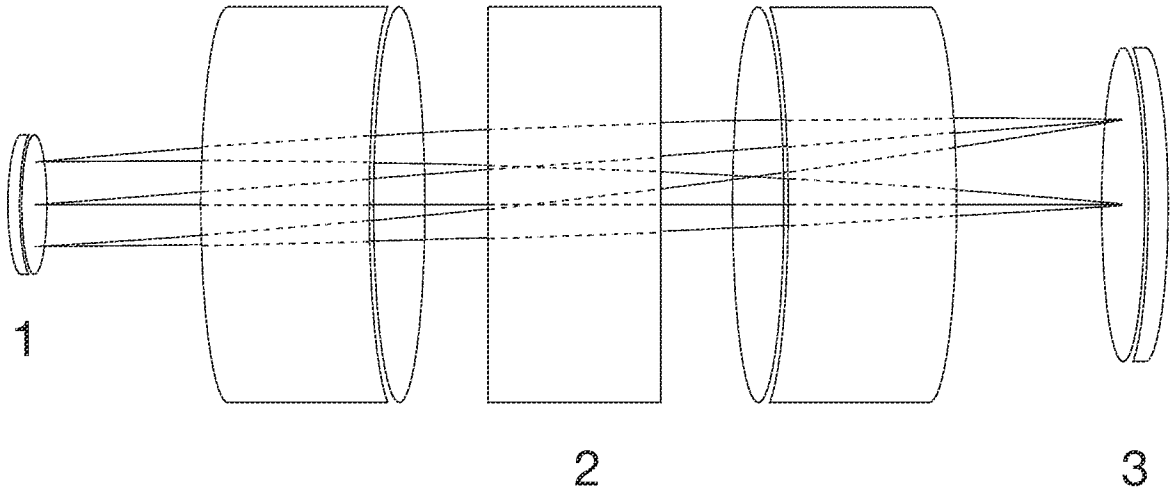
1
2
3

MOMENTUM-RESOLVING PHOTOELECTRON SPECTROMETER AND METHOD FOR MOMENTUM-RESOLVED PHOTOELECTRON SPECTROSCOPY

CROSS REFERENCE TO RELATED APPLICATIONS

This application is the U.S. national stage of International Application No. PCT/EP2018/084995, filed on 2018 Dec. 14. The international application claims the priority of DE 102017130072.4 filed on 2017 Dec. 15; all applications are incorporated by reference herein in their entirety.

BACKGROUND

The invention relates to the field of physics and relates to a momentum-resolved photoelectron spectrometer, by means of which and by means of the method for momentum-resolved photoelectron spectroscopy the physical properties of materials can be determined on the basis of their energy distribution and electronic structure.

The physical properties of materials such as the electrical resistance, the optical absorption, the plasticity, etc., are determined by the electronic structure of the material. Therefore, it is advantageous and necessary to obtain comprehensive and detailed knowledge of the electronic structure of the materials. Further, this knowledge can also contribute to the prediction of new compounds and/or physical properties. Likewise, this knowledge can be used to construct electronic components, such as transistors, or solar cells with due regard for their properties.

In order to ascertain the electronic structure of a material, it is necessary to ascertain the behavior of electrons in the material and, in particular, their energy and their momentum.

The momentum describes the mechanical movement state of an electron. In contrast to kinetic energy, momentum is a vector quantity and consequently has a magnitude and a direction (German Wikipedia; "Impuls" [Momentum] entry).

The best known method for ascertaining the energy and the momentum of electrons in a solid lies in the use of Einstein's law of the photoelectric effect, for which he was awarded the Nobel prize. Here, within the scope of an experiment, monochromatic light striking a metal surface caused the ejection of electrons from said surface. These photoelectrons carry information about their energy and their momentum in the material. Thus, if their kinetic energy and their directions, i.e., their momentum, upon emergence from the surface can be ascertained, it is possible to draw conclusions about the physical properties of the material.

However, this is not easy to realize, at least for the following reasons, since many criteria have to be considered when ascertaining energy and momentum.

Thus, the surface of the material must be atomically clean, which can only be achieved in ultrahigh vacuum (UHV). In turn, this leads to the ejection and ascertainment of the photoelectrons, in general, and of their direction also having to be carried out in UHV, severely restricting the technical options.

Further, external electric and magnetic fields along the path of the light and of the photoelectrons to the detector must be largely prevented and/or shielded since otherwise there are changes in the measurement result, which lead to erroneous results.

In order to obtain meaningful and relevant measurement results, it is necessary to determine the energy and momentum of as many ejected photoelectrons as possible, necessitating complicated detection devices.

To this end, use is made of electron spectrometers, which serve to analyze the energy and momentum of electrons. As a rule, they consist of a lens, an analyzer which passes electrons of a given energy with a given propagation direction, and of a detector (German Wikipedia; "Elektronenspektrometer" [Electron spectrometer] entry).

Lenses in an electron spectrometer are electron lenses.

Electron lenses are components for deflecting electron beams by way of inhomogeneous electric and/or magnetic fields. In a manner analogous to optical lenses, electron lenses can be used to image beams emanating in different directions from a point back on one point (www.s-pektrum.de/lexikon/physik/elektronenlinsen).

In general, electron lenses are constructed from a plurality of tube lenses or apertures with a potential field. As a result of the different potentials of the electron lenses, these act as a converging lens or diverging lens. This can be used to construct a potential field for electrons, said potential field being able to, firstly, accelerate or decelerate said electrons and, secondly, focus said electrons at a given desired point.

The analyzer has an entrance slit for the electrons and an exit slit to the detector or spatially resolved detectors. The deflection of electrons in an electric or magnetic field is exploited for filtering the electron energy. Only the electrons with a given amount of energy (pass energy) which strike the entrance slit within a given angular range in one direction are then able to pass the entrance and exit slit. The pass energy of the filter is controlled by altering the voltage such that, in that case, it is also possible for electrons of different energy to pass.

The electrons that have passed through are counted for various pass energies by the detector and this is presented as a distribution of the number of electrons from a given direction. Then, ascertaining the distribution of the number of electrons from a multiplicity of directions allows an energy distribution of the electrons over this multiplicity of directions to be ascertained and to be represented, usually pictorially.

By way of example, the detectors are spatially resolved detectors, which consist of a microchannel plate (MCP) and a fluorescence screen.

Apparatuses for angle-resolved photoemission spectroscopy (ARPES) are already known for the purpose of realizing these examinations. These apparatuses allow a direct investigation of the electronic structure of materials. The ultimate task of such an electron analyzer is that of determining the kinetic energy and the direction with which photoelectrons leave the surface of materials. These apparatuses can be divided into three classes: display-type electron analyzers, hemispherical electron analyzers and time-of-flight electron analyzers.

A typical representative of the first class is the spectrometer based on the mesh arrangement. Electrons leaving the sample fly through the plurality of spherical meshes, which act as high-pass and low-pass filters and only select the electrons intended to reach the detector and intended to be counted. The advantage of these display-type electron analyzers consists of a relatively large proportion of momentum space being able to be examined immediately (large angle acceptance), with the structure typically comprising many elements including the mirrors and spherical meshes (D. Rieger et al: Nucl. Instr. Methods, 208, 777 (1983); H. Matsuda et al: J. Electron Spectrosc. Relat. Phenom. 195, 382-398 (2014)). The spherical meshes limit the resolution on account of the microlens effect in conjunction with the finite size of the mesh cells. As a consequence, the energy resolution and momentum resolution of such spectrometers is comparatively poor in comparison with what is obtainable by hemispherical electron analyzers.

Such hemispherical electron analyzers are the most successful apparatuses of the aforementioned classes. Their energy resolution can reach a sub-meV level while their angular resolution can even be as good as 0.2°. This is achieved by a sophisticated combination of the electron lens and two hemispheres (N. Martensson et al: J. Electron Spectrosc. Relat. Phenom. 70, 117-128, (1994)).

Initially, the electron lens, which consists of 5-7 elements, projects the electron beams to the entrance slit of the analyzer. The electron optical unit is set so that the entrance slit lies in the focal plane of the electron lens, meaning that electrons which have left the sample surface at a given angle are located on the circle with a special radius within this plane. As a consequence, the distance from the center of the entrance slit corresponds to this angle, which is the convenient option for distinguishing therebetween and measuring the angular distribution. Subsequently, all these electrons that have passed through the entrance slit are analyzed in terms of energy.

The disadvantage of these solutions consists of only a small portion of all photoelectrons being analyzed at the same time. In order to consider the remainder, it is necessary either to rotate the sample, a demanding task in UHV, or to alter the voltages of the lens elements in order to be able to project different electron beams to the entrance slit. Both solutions for improving the disadvantages of such hemispherical electron analyzers bring improvements up to a point; however, on account of the multiplicity of parameters that then have to be adapted, the measurements are very time-consuming and require a great amount of equipment on the electron analyzer, which is very costly.

EP 2 851 933 B1 has disclosed a method for determining a parameter of charged particles and a photoelectron spectrometer of the hemisphere-deflector type for analyzing a particle emission sample. Here, the photoelectron spectrometer consists of a measurement region, a lens system with a substantially straight optical axis, a deflector arrangement which deflects the particle beam at least twice, a capturing arrangement which is able to capture the positions of the charged particles in the measurement region in two dimensions, and a control unit which controls the deflector arrangement.

The time-of-flight electron analyzers operate according to the eponymous TOF technology (R. Ovsyannikov et al: J. Electron Spectrosc. Relat. Phenom. 191, 92-103 (2013)). In contrast to the hemispherical electron analyzers, the TOF electron analyzers have no entrance slits and hemispheres. The electrons are collected in a cone and their energy and momentum are measured simultaneously. Energy filtering is implemented by virtue of the detector being disposed very far away from the sample to be examined, and the electron time of flight is measured by the spectrometer. To this end, use is often made of microchannel plate detectors (microchannel plates) and delay line detectors.

As per WO 2011/019457, there is a time-of-flight electron analyzer that can be used to ascertain the kinetic energy of a particle beam of a sample, said time-of-flight electron analyzer consisting of a first, second and third lens system and a 90° bandpass filter, from which two spherical electrically conductive plates are coupled to the first and third lens system and said time-of-flight electron analyzer having a high-speed multichannel detector (MCP), which captures the photoemitted electrons following the reflection by a target.

The principal disadvantage of the method with the TOF electron analyzers essentially consists of it being necessary to realize pulsed radiation with a relatively narrow pulse width. Consequently, the use of synchrotron radiation is restricted to a single-bunch mode of operation and the repetition rates of laboratory lasers are usually too low to supply an adequate information rate.

In respect of all apparatuses of the prior art for ascertaining the electronic structure of a material, it should be noted that a multiplicity of measurements are required in each case in order to determine the desired distribution of the momentum for a given kinetic energy of the photoelectrons. Likewise, comprehensive and costly apparatuses are often required for such measurements.

SUMMARY

The object of the present invention consists of specifying a momentum-resolved photoelectron spectrometer which realizes a simple structure of the apparatus components with a significantly reduced build volume and with which the ascertainment of the distribution of the momentum of photoelectrons at a given kinetic energy using a method for momentum-resolved photoelectron spectroscopy is realized significantly more easily and efficiently.

The object is achieved by the invention specified in the claims. Advantageous embodiments are the subject matter of the dependent claims.

DETAILED DESCRIPTION

The momentum-resolved photoelectron spectrometer according to the invention contains components disposed in succession along the direction of the optical axis at least within a vacuum, said components respectively being at least one electron emission sample and a focusing system, wherein the focusing system consists of at least one electron lens and at least one detector, wherein the electron lens consists of three cylindrical elements which are disposed in succession and at a distance from one another along the direction of the optical axis, wherein the first cylindrical element has a potential equal to 0 and the two subsequently disposed cylindrical elements have a potential not equal to 0, with these two cylindrical elements not having the same potential, and wherein the focusing system focuses and detects electrons which respectively have substantially the same kinetic energy and, of these electrons, those which have left the electron emission sample with the same momentum are focused at substantially one point in the focal plane of the focusing system for this same kinetic energy, and wherein the detector is one or more spatially resolved detectors which are disposed in the focal plane of the focusing system, and wherein a lower limit of the kinetic energy of the electrons to be focused and detected is adjustable up to the Fermi energy in the focusing system by way of applying an different voltage to the cylindrical elements of the electron lens and/or the detector.

Advantageously, the components are disposed in a chamber in which there is a high vacuum or an ultra-high vacuum, at least during the measurements.

Furthermore advantageously, the electron emission sample consists of the material to be examined.

Likewise advantageously, the electron lens of the focusing system generates an electric field, by means of which a focal plane for a given kinetic energy of electrons is generated, in which the focusing of the electrons with this given and same kinetic energy and with the same momentum is realized.

Additionally advantageously, the electron lens of the focusing system consists of a container having a cylindrical entrance opening and two further cylindrical elements disposed in succession therein.

It is also advantageous if the at least one detector is disposed in the focal plane of the electron lens as a microchannel plate, with even more advantageously the detector or detectors being disposed transversely to the optical axis in the container, downstream of the three cylindrical elements.

It is furthermore advantageous if mesh are disposed upstream of the detectors, said meshes advantageously also being disposed in the container and/or advantageously also being disposed in the focal plane of the electron lens.

It is likewise advantageous if the electron lens and/or the detector in the focal plane of the electron lens are embodied to be alterable, by applying a voltage, in respect of the detectability of the kinetic energy of the electrons to be focused and detected.

In the method according to the invention for momentum-resolved photoelectron spectroscopy, electrons are released from an electron emission sample and guided through a focusing system, wherein the focusing system generates an electric field, by means of which the focusing of electrons is realized in a focal plane of the focusing system which is assigned to a given kinetic energy, from a desired kinetic energy to the Fermi energy, and wherein all electrons with this desired kinetic energy and substantially the same momentum, i.e., substantially the same emission direction from the electron emission sample, are focused and detected substantially at one point on a detector in the focal plane of the focusing system.

Advantageously, electrons are released from the surface of the electron emission sample by means of a photon beam in the form of synchrotron radiation, laser radiation or radiation from other radiation sources, such as a helium lamp, the photon beam more advantageously being a monochromatic photon beam.

Likewise advantageously, only electrons with substantially the Fermi energy are focused and detected by the focusing system.

Further advantageously, the desired kinetic energy of the electrons to be focused, up to the Fermi energy, is set by applying an altered voltage to the electron lens and/or the detector in the focal plane of the focusing system.

Additionally advantageously, upstream of the detector, the focusing system brakes substantially all electrons which have a kinetic energy below the desired kinetic energy of the electrons to be detected and consequently said braked electrons are not detected.

It is also advantageous if, upstream of the detector, the focusing system accelerates and detects substantially all electrons which have the desired kinetic energy up to the Fermi energy of the electrons to be detected, even more advantageously the acceleration of the electrons to be detected, which have the desired kinetic energy up to the Fermi energy, being realized by means of meshes upstream of the detector in the focal plane of the electron lens.

Furthermore, it is advantageous if, for the purposes of ascertaining the momentum distribution of electrons at a desired kinetic energy below the Fermi energy, electrons with the desired kinetic energy up to the Fermi energy are focused and the momentum distribution is ascertained and, subsequently, electrons with a higher kinetic energy up to the Fermi energy are focused and the momentum distribution is ascertained, and subsequently the momentum distribution at the higher energy is subtracted from the momentum distribution at the desired kinetic energy.

It is likewise advantageous if the momentum distribution of the emitted electrons as a function of their kinetic energy is ascertained as a pictorial representation.

It is additionally advantageous if statements about the physical properties of the electron emission sample are derived from the ascertained values of the momentum distribution of the emitted electrons depending on their energy.

The solution according to the invention renders it possible for the first time to specify a momentum-resolved photoelectron spectrometer which realizes a simple structure of the apparatus components with a significantly reduced build volume and with which the ascertainment of the distribution of the momentum of photoelectrons at a given kinetic energy using a method for momentum-resolved photoelectron spectroscopy is realized significantly more easily and efficiently.

This is achieved by a momentum-resolved photoelectron spectrometer which has components disposed in succession along the direction of the optical axis at least within a vacuum, said components respectively being at least one electron emission sample and a focusing system with an electron lens and a detector.

A complicated hemisphere arrangement with an entrance slit is not necessary.

All these necessary components are disposed at least within a vacuum, this advantageously being implemented within a chamber and the vacuum advantageously being a high vacuum or ultra-high vacuum. According to the invention, an ultra-high vacuum is intended to be present in the range from $10^{-7}$ to $10^{-10}$ hPa.

Here, the electron emission sample exists at least in part and in the region of incidence of the photon beam for the purposes of releasing electrons from the material to be examined.

Further, a focusing system is present according to the invention, said focusing system consisting of an electron lens and a detector.

Using the electron lens according to the invention, electrons which respectively have substantially the same kinetic energy and, of these electrons, those which have left the electron emission sample with substantially the same emission direction are focused at substantially one point in the respective focal plane of the electron lens which corresponds to the desired kinetic energy. Here, the detector is located in this focal plane in each case.

For the purposes of focusing and detecting electrons with a given kinetic energy E1 and the same emission direction, the focusing system generates an electric field which generates a focal plane for the kinetic energy E1. The focal planes intersect the optical axis and can be generated at different distances from the electron emission sample along said optical axis. Then, the detector is located in this focal plane.

For the purposes of focusing and detecting electrons with a different given kinetic energy E2 and a different, but in each case the same emission direction, the focal plane generated by the focusing system is located at a different distance from the electron emission sample along the optical axis.

In this case, the electron lens consists of three cylindrical elements which are disposed in succession and at a distance from one another along the direction of the optical axis of the apparatus according to the invention. Here, the first cylindrical element has a potential equal to 0 and the two subsequently disposed cylindrical elements have a potential not equal to 0, with these two cylindrical elements not having the same potential.

The cylindrical elements generate a potential field in their interior, said potential field focusing the electrons emerging from the electron emission sample.

The electrons that should be focused each have the same kinetic energy above a common lower limit of the kinetic energy and each have the same emission direction from the electron emission sample. These electrons are all focused at one point in the respective focal planes of the focusing system.

It is important to the solution according to the invention that the electrons emitted by the electron emission sample have a kinetic energy corresponding to their energy in the crystal of the material of the electron emission sample.

It is well-established that electrons have a highest energy, the so-called Fermi energy. Electrons cannot have a higher energy. Here, too, the kinetic energy of these electrons corresponds to the Fermi energy in the crystal and is also denoted Fermi energy below.

Proceeding from there being a highest energy of electrons and hence also a highest kinetic energy of electrons of an electron emission sample, it is only ever possible to focus and detect electrons with a lower energy or with the Fermi energy.

The particular advantage of the apparatus according to the invention consists of focusing electrons with different kinetic energies and emission directions and thus allowing the detection of a multiplicity of individual points in the respective focal planes.

It is important to the solution according to the invention that the apparatus can be used to set a lower limit of the kinetic energy to be detected by setting the potential field by the electron lens and/or the detector, or else by the installation of meshes within the electron lens and upstream of the detector. Electrons with a kinetic energy below the desired lower limit are braked and hence not detected. Then, all electrons with a kinetic energy above the desired set lower limit, up to electrons with the Fermi energy, can be focused and detected.

Within the scope of this invention, the focal plane of the electron lens should be understood to mean that all electrons with the same kinetic energy are focused in the respective focal plane, which is generated by the respective potential field of the focusing system. All electrons with this kinetic energy which have left the electron emission sample at the same angle in the x- and y-direction are then focused at one point in this plane. Electrons at this kinetic energy with a different, but in each case the same emergence angle are then focused at a different point in the focal plane. All electrons emerging from the electron emission sample at the same kinetic energy are then focused on any point in this focal plane such that a focal plane made of many focuses arises.

Advantageously, the focal plane of the electron lens is not just a plane in two-dimensional space; instead, it could be an area in three-dimensional space, which area may for example have an arched or spherical embodiment or which area may have one or multiple depressions and elevations therewithin.

Advantageously, the electron lens and the detector can be disposed in a container within the chamber, the container having an electron entrance opening which advantageously is also an element of the electron lens.

The electrons are focused by an electric field which is generated by the cylindrical elements, at different potentials, of the electron lens and of the detector.

According to the invention, the electron lens of the focusing system is an electron lens consisting of three cylindrical elements which are disposed in succession in the direction of the optical axis.

Here, the detector is one or more spatially resolved detectors, with all detectors being disposed in the respective focal plane of the electron lens. The detectors could be disposed in displaceable fashion on the optical axis of the apparatus according to the invention, at different distances from the electron emission sample, and so these detectors can detect electrons in a plurality of focal planes in succession. However, the focal planes could also be generated at the position of the detectors in each case by changing the electric field by way of the focusing system.

Advantageously, the at least one detector in the focal plane of the electron lens is embodied as a microchannel plate.

A particular advantage of the focusing system according to the invention is that meshes can be disposed upstream of the detector or detectors in the direction of the optical axis, said meshes realizing an acceleration of the electrons to be detected with the desired kinetic energy upstream of the detector of the electron lens, as a result of which the electrons become better detectable by the detector. To this end, the voltage braking the electrons can be applied to the detector only or not to the detector but to a mesh. In the latter case, a different voltage is applied between the mesh and the detector surface, said voltage accelerating the passing electrons. If such a mesh is used upstream of the detector, the mesh is positioned in the focal plane of the electron lens and the detector is positioned directly therebehind, often at a distance of only a few centimeters.

Further, by applying a different voltage to the container and/or the electron lens and/or the detector and by generating a focal plane of the electron lens, the lower limit of the kinetic energy of the electrons to be focused and detected is adjustable with the aid of the focusing system.

An analyzer which has an entrance slit for electrons emitted by the electron emission sample and focused by the focusing system could also be present. However, this is not mandatory according to the invention.

Advantageously, the electron lens and the detector in the focal plane of the electron lens or only the electron lens can have a changeable embodiment in respect of the detectability of the kinetic energy of the electrons to be focused and detected and the emergence angle of the electrons from the electron emission sample, by virtue of applying a voltage.

In the method according to the invention for momentum-resolved photoelectron spectroscopy, electrons are released from an electron emission sample and guided through a focusing system, wherein the focusing system generates an electric field, by means of which the focusing of electrons with a desired kinetic energy is realized in the focal plane of the electron lens generated for this kinetic energy, and wherein all electrons with this desired kinetic energy and substantially the same momentum, i.e., substantially the same emission direction from the electron emission sample, are focused and detected substantially at one point on a detector in the respective focal plane of the electron lens.

The momentum distribution of the emitted electrons is ascertained by way of the electrons striking the detector.

Within the scope of the present invention, momentum of electrons should be understood to mean the emission direction, determined by the angle pair in the x-direction and y-direction or the polar angle and azimuth angle, with which the electrons emerge from the surface of the material of the electron emission sample to be examined.

In contrast to kinetic energy, momentum is a vector quantity and consequently has a magnitude and a direction. The direction of the momentum is the movement direction of the object. The magnitude of the momentum is the product of the mass of the object and the speed of its center of mass (German Wikipedia; "Impuls" [Momentum] entry).

Here, electrons, which are subsequently focused and detected, are advantageously released from the surface of the electron emission sample by means of a photon beam in the form of synchrotron radiation or laser radiation or by means of radiation from other radiation sources, such as a helium lamp. Advantageously, the photon beam with which the electrons are released from the electron emission sample is monochromatic.

The Fermi energy of the electrons, in particular, is of importance as given desired kinetic energy. Therefore, it is particularly advantageous that, in particular, only electrons with substantially the Fermi energy are detected by the apparatus according to the invention. This is particularly important since the momentum distribution at the Fermi energy contains substantially all information or the most important information in respect of the physical properties of the material of the electron emission sample for substantially all electron emission samples to be examined.

Here, it is particularly advantageous that only one measurement with the apparatus according to the invention is required for ascertaining the momentum distribution at the Fermi energy since the lower desired limit of the kinetic energy is the highest possible kinetic energy at the same time.

The following procedure according to the invention should be realized for ascertaining the momentum distribution at kinetic energies other than the Fermi energy of the electrons:

According to the invention, the momentum distribution of the emitted electrons is detected at any other energy, which is lower than the Fermi energy.

Advantageously, this can be realized by applying a different voltage to the electron lens and/or the detector by virtue of setting the desired lower limit of the kinetic energy of the electrons to be focused. This brakes all electrons with a kinetic energy lower than the desired kinetic energy and said electrons do not reach the detector.

Then, the momentum distribution of the emitted electrons from the electron emission sample is ascertained at an energy that is slightly higher than the energy of the first measurement, which was set as lower limit of the kinetic energy.

Subsequently, the momentum distribution at the slightly higher kinetic energy is subtracted from the momentum distribution at the lower kinetic energy.

The accuracy of the momentum distribution at the lower kinetic energy is determined by the difference between the respectively set kinetic energies, at which the measurements are implemented.

Furthermore, substantially all electrons that do not have the desired kinetic energy of the electrons to be detected can advantageously be braked upstream of the detector by the focusing system according to the invention and consequently need not be detected. As it were, this solution achieves the effect of a low-pass filter.

Then again, however, the focusing system according to the invention advantageously also renders it possible for substantially all electrons that have the desired kinetic energy of the electrons to be detected, up to the Fermi energy, to be accelerated upstream of the detector and be detected more effectively.

By way of example, this can be realized by means of meshes.

Furthermore, it is an advantage of the present solution according to the invention that the momentum distribution of the emitted electrons on the basis of their energy can be realized as a pictorial representation.

The method according to the invention for momentum-resolved photoelectron spectroscopy can be realized using the photoelectron spectrometer according to the invention.

It is advantageous that the method according to the invention and the momentum-resolved photoelectron spectrometer according to the invention allow expensive and complicated components to be saved, such as meshes or hemispherical analyzers, for example. Likewise, it is possible to work with conventional light sources.

Using the solution according to the invention, good to very good momentum resolutions are ascertainable at desired kinetic energies of the electrons. The momentum resolution is a measure of the accuracy of the momentum distribution.

The signals are obtainable at the same time for a large portion of the space to be detected (momentum space), in a solid angle range up to 30°; otherwise, this is only possible using ToF and display-type analyzers. Furthermore, the momentum distribution is imaged almost directly onto the detector in the focal plane of the electron lenses using the solution according to the invention, without having to recalculate this from the angle distribution.

The essential difference of the solution according to the invention from the solutions of the prior art consists in particular of the fact that it is not electrons at different kinetic energies which only emerge from the electron emission sample at a certain emission direction that are detected but that electrons with a given desired kinetic energy and any emission direction (i.e., momentum) are focused and detected.

This allows the momentum distribution at a given, desired kinetic energy of electrons of an electron emission sample to be ascertained using substantially two measurements and allows the physical properties of the electron emission sample to be deduced immediately.

Only one measurement is required in the case of a measurement at the Fermi energy of the electrons since there are no electrons in the crystal of a material that have a kinetic energy higher than the Fermi energy.

The momentum distribution at a desired energy of the electrons can only be ascertained by way of a significantly greater number of measurements and/or by way of significantly more outlay in terms of apparatuses using the solutions according to the prior art.

For this reason, and on account of the arrangement of the components according to the invention and their interaction when applying the method according to the invention, it is also not necessary for the electron emission sample to be moved and/or rotated during the detection.

At the same time, the solution according to the invention achieves a higher transmission of electrons and hence a higher intensity of the electrons at the detector, leading to a higher information rate for the evaluation of the ascertained date.

Likewise, together with a greater acceptance angle of the momentum-resolved photoelectron spectrometer according to the invention, the data capture at the detector or detectors becomes significantly faster, and so more information can also be collected from the electron emission sample on account thereof.

BRIEF DESCRIPTION OF THE DRAWINGS

FIG. 1 shows the electron emission sample, electron lens and detector of the impulse-resolving photo-electron spectrometer

DETAILED DESCRIPTION OF THE PREFERRED EMBODIMENTS

The invention is explained in more detail below using an exemplary embodiment.

Example 1

In a vacuum chamber which is evacuable to a vacuum of $10^{-10}$ hPa, an electron emission sample and a focusing system are disposed in succession in the direction of the optical axis, proceeding from the electron emission sample.

The electron emission sample consists of $TaSe_2$ and has the following dimensions: 1 mm surface diameter and 0.2 mm height.

The focusing system consists of an electron lens and a detector.

The electron lens consists of a cylindrical container with a length of 108 mm and a diameter of 140 mm and a cylindrical entrance opening with a 30 mm diameter and 15 mm length.

Two cylindrical elements, each with a radius of 49 mm, are disposed in succession in the container along the direction of the optical axis and are spaced apart 5 mm; the first cylinder has a length of 35 mm and the second cylinder has a length of 42 mm. The cylindrical element next to the entrance opening of the container is located at a distance of 11 mm from the inner edge of the cylindrical entrance opening.

These two cylindrical elements and the cylindrical entrance opening of the container together form the electron lens.

The sample is disposed at a distance of 28 mm from the container opening.

The detector is a circular microchannel plate with a diameter of 75 mm, which is disposed in the container, transversely to the optical axis and at a distance of 130 mm from the sample, i.e., still within the second cylindrical element, and which is coupled to a phosphor screen disposed therebehind (standard design; so-called MCP assembly).

The electrons are emitted from the sample surface by way of the radiation of the He lamp with a photon energy of 21.2 eV. Due to the work function of approximately 4.2 eV of $TaSe_2$, the electrons have the highest kinetic energy of ~17 eV, depending on the temperature of the sample. This energy is the Fermi energy and the corresponding momentum distribution is the so-called Fermi surface. To record the Fermi surface of $TaSe_2$, the following voltages are applied to the focusing elements:

Container $V_G$=0 V;

First cylinder $V_1$=−16.8 V;

Second cylinder $V_2$=−16.65 V;

Detector surface $V_D$=−17 V.

Using these settings, all electrons with energies of less than 17 eV are braked and do not reach the detector. The electrons with the Fermi energy are focused in the focal plane by the electron lens and strike the surface of the microchannel plate. All electrons with Fermi energy, which have left the surface of the sample, are focused here, with all electrons with the same emission direction, i.e., the same momentum, being focused on a certain point on the detector surface.

Since the momentum of the electrons is defined at the Fermi energy as a result of this emission direction, the intensity distribution at the surface of the detector (MCP) directly corresponds to the Fermi momentum distribution or the Fermi surface of $TaSe_2$. This intensity distribution is amplified by the detector (MCP) and is visible on the coupled phosphor screen. It can be recorded by the CCD camera from outside of the vacuum camera through the window flange.

Example 2

To record the momentum distribution of the electrons with energies below the Fermi energy (e.g., 16.98 eV), all negative voltages are reduced proportionally ($V_G$=0 V, $V_1$=−16.78 V, $V_2$=−16.63 V, $V_D$=−16.98 V).

In this case, all electrons with an energy of 16.98 eV and more, up to the Fermi energy, reach the detector. To ascertain the momentum distribution at 16.98 eV, the momentum distribution at the Fermi energy of the electrons of the same sample is subtracted in order to obtain the desired momentum distribution of the electrons with a kinetic energy of 16.8 eV.

LIST OF REFERENCE NUMERALS

1 Electron emission sample
2 Electron lens made up of three cylindrical elements
3 Detector

The invention claimed is:

1. A momentum-resolved photoelectron spectrometer, containing components disposed in succession along the direction of the optical axis at least within a vacuum, said components respectively being at least one electron emission sample and a focusing system, wherein the focusing system consists of at least one electron lens and at least one detector, wherein the electron lens consists of three cylindrical elements which are disposed in succession and at a distance from one another along the direction of the optical axis, wherein the first cylindrical element has a potential equal to 0 and the two subsequently disposed cylindrical elements have a potential not equal to 0, with these two cylindrical elements not having the same potential, and wherein the focusing system focuses and detects electrons which respectively have substantially the same kinetic energy and, of these electrons, those which have left the electron emission sample with the same momentum are focused at substantially one point in the focal plane of the focusing system for this same kinetic energy, and wherein the detector is one or more spatially resolved detectors which are disposed in the focal plane of the focusing system, and wherein a lower limit of the kinetic energy of the electrons to be focused and detected is adjustable up to the Fermi energy in the focusing system by way of applying an altered voltage to the cylindrical elements of the electron lens and/or the detector.

2. The momentum-resolved photoelectron spectrometer as claimed in claim 1, wherein the components are disposed in a chamber in which there is a high vacuum or an ultra-high vacuum, at least during the measurements.

3. The momentum-resolved photoelectron spectrometer as claimed in claim 1, wherein the electron emission sample consists of the material to be examined.

4. The momentum-resolved photoelectron spectrometer as claimed in claim 1, wherein the electron lens of the focusing system generates an electric field, by means of which a focal plane for a given kinetic energy of electrons is generated, in which the focusing of the electrons with this given and same kinetic energy and with the same momentum is realized.

5. The momentum-resolved photoelectron spectrometer as claimed in claim 1, wherein the electron lens of the focusing system consists of a container having a cylindrical entrance opening and two further cylindrical elements disposed in succession therein.

6. The momentum-resolved photoelectron spectrometer as claimed in claim 1, wherein the at least one detector is disposed in the focal plane of the electron lens as a microchannel plate.

7. The momentum-resolved photoelectron spectrometer as claimed in claim 6, wherein the detector or detectors is/are in disposed in the container transversely to the optical axis and downstream of the three cylindrical elements.

8. The momentum-resolved photoelectron spectrometer as claimed in claim 1, wherein meshes are disposed upstream of the detectors, said meshes advantageously also being disposed in the container and/or advantageously also being disposed in the focal plane of the electron lens.

9. The momentum-resolved photoelectron spectrometer as claimed in claim 1, wherein the electron lens and/or the detector in the focal plane of the electron lens are embodied to be alterable, by applying a voltage, in respect of the detectability of the kinetic energy of the electrons to be focused and detected.

10. A method for momentum-resolved photoelectron spectroscopy, wherein electrons are released from an electron emission sample and guided through a focusing system, wherein the focusing system generates an electric field, by means of which the focusing of electrons is realized in a focal plane of the focusing system which is assigned to a given kinetic energy, from a desired kinetic energy to the Fermi energy, and wherein all electrons with this desired kinetic energy and substantially the same momentum, i.e., substantially the same emission direction from the electron emission sample, are focused and detected substantially at one point on a detector in the focal plane of the focusing system.

11. The method as claimed in claim 10, wherein electrons are released from the surface of the electron emission sample by means of a photon beam in the form of synchrotron radiation or radiation from a helium lamp.

12. The method as claimed in claim 10, wherein only electrons with substantially the Fermi energy are focused and detected by the focusing system.

13. The method as claimed in claim 10, wherein the desired kinetic energy of the electrons to be focused, up to the Fermi energy, is set by applying a different voltage to the electron lens and/or the detector in the focal plane of the focusing system.

14. The method as claimed in claim 10, wherein, upstream of the detector, the focusing system brakes substantially all electrons which have a kinetic energy below the desired kinetic energy of the electrons to be detected and consequently said braked electrons are not detected.

15. The method as claimed in claim 10, wherein, upstream of the detector, the focusing system accelerates and detects substantially all electrons which have the desired kinetic energy up to the Fermi energy of the electrons to be detected.

16. The method as claimed in claim 15, wherein the acceleration of the electrons to be detected, which have the desired kinetic energy up to the Fermi energy, is realized by means of meshes upstream of the detector in the focal plane of the electron lens.

17. The method as claimed in claim 10, wherein, for the purposes of ascertaining the momentum distribution of electrons at a desired kinetic energy below the Fermi energy, electrons with the desired kinetic energy up to the Fermi energy are focused and the momentum distribution is ascertained and, subsequently, electrons with a higher kinetic energy up to the Fermi energy are focused and the momentum distribution is ascertained, and subsequently the momentum distribution at the higher energy is subtracted from the momentum distribution of the desired kinetic energy.

18. The method as claimed in claim 10, wherein the momentum distribution of the emitted electrons as a function of their kinetic energy is ascertained as a pictorial representation.

19. The method as claimed in claim 10, wherein statements about the physical properties of the electron emission sample are derived from the ascertained values of the momentum distribution of the emitted electrons depending on their energy.

20. The method as claimed in claim 10, wherein electrons are released from the surface of the electron emission sample by means of a photon beam, said photon beam being a monochromatic photon beam.

* * * * *